US008079870B2

(12) United States Patent
Nakamura et al.

(10) Patent No.: US 8,079,870 B2
(45) Date of Patent: Dec. 20, 2011

(54) COAXIAL CONNECTOR WITH EFFICIENT ASSEMBLY OPERATION

(75) Inventors: Masatoshi Nakamura, Makinohara (JP); Taishi Morikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/864,259

(22) PCT Filed: Jan. 26, 2009

(86) PCT No.: PCT/JP2009/051223

§ 371 (c)(1),
(2), (4) Date: Jul. 23, 2010

(87) PCT Pub. No.: WO2009/096338

PCT Pub. Date: Aug. 6, 2009

(65) Prior Publication Data

US 2010/0297877 A1 Nov. 25, 2010

(30) Foreign Application Priority Data

Jan. 30, 2008 (JP) ..... 2008-018620

(51) Int. Cl.
*H01R 9/05* (2006.01)

(52) U.S. Cl. ..... 439/585; 439/877

(58) Field of Classification Search ..... 439/585, 439/877, 98

See application file for complete search history.

(56) References Cited

U.S. PATENT DOCUMENTS

| | | | | |
|---|---|---|---|---|
| 3,958,851 | A * | 5/1976 | Evans | 439/295 |
| 6,808,417 | B2 | 10/2004 | Yoshida | |
| 7,140,914 | B2 * | 11/2006 | Kojima | 439/585 |
| 7,198,509 | B2 | 4/2007 | Takasu | |
| 2011/0028034 | A1 * | 2/2011 | Morikawa | 439/578 |

FOREIGN PATENT DOCUMENTS

| | | | |
|---|---|---|---|
| JP | 7-335311 | A | 12/1995 |
| JP | 2003-109712 | A | 4/2003 |
| JP | 2003-297493 | A | 10/2003 |
| JP | 2005-317260 | A | 11/2005 |

OTHER PUBLICATIONS

International Search Report (PCT/ISA/210), dated Mar. 3, 2009, for PCT/JP2009/051223.

* cited by examiner

*Primary Examiner* — Hae Moon Hyeon
(74) *Attorney, Agent, or Firm* — Sughrue Mion, PLLC

(57) ABSTRACT

To provide a coaxial connector and an assembling method of the coaxial connector in which an operation efficiency can be enhanced, and also facilities related to the assembling can be simplified. The coaxial connector is assembled through a first step of assembling an insulator assembly, a second step of setting the insulator assembly in an outer conductor terminal through an upper opening portion of the outer conductor terminal from a direction perpendicular to a terminal axis thereof, and a third step of holding an insulator of the insulator assembly by press-crimping a pair of press-crimping pieces for insulator holding and effecting the connection and fixing to a coaxial cable of the insulator assembly by press-crimping a pair of press-crimping pieces for braid connection and a pair of press-crimping pieces for sheath fixation.

6 Claims, 6 Drawing Sheets

COAXIAL CONNECTOR WITH EFFICIENT ASSEMBLY OPERATION

TECHNICAL FIELD

The present invention relates to a coaxial connector provided at an end of a coaxial cable and also to a method of assembling this coaxial connector.

BACKGROUND ART

Generally, a coaxial cable used for transmitting a high-frequency signal such as an antenna wire comprises, in outward order from the center, a core wire as a center conductor, an insulator as a dielectric member, a metallic tape conductor and a braid as an outer conductor, and insulative sheath as an outer covering. The coaxial cable of such a construction has a coaxial connector provided at an end thereof so that it can be connected to a mating equipment, a mating coaxial cable or the like (see, for example, JP-A-2003-297493).

The coaxial connector has an inner conductor terminal and an insulator receiving the inner conductor terminal therein, and also has an outer conductor terminal for groundedly connecting the braid of the coaxial cable to a mating coaxial connector so as to intercept electrical noises such as electromagnetic waves and static electricity. An outer conductor terminal disclosed in JP-A-2003-297493 is constructed such that it comprises an outer conductor terminal body of a cylindrical shape, and a shielding member which has press-crimping piece for braid connections and is fitted to an opening portion in the outer conductor terminal body.

For assembling the coaxial connector disclosed in JP-A-2003-297493, the insulator is beforehand received and retained in the outer conductor terminal body, and in this condition the inner conductor terminal connected to the core wire of the coaxial cable is inserted into the outer conductor terminal body, and is received and retained in the insulator, and then the shielding member is fitted to the outer conductor terminal body, and finally the press-crimping pieces of the shielding member are press-crimped to the braid of the coaxial cable to be connected thereto, thereby completing the operation. The operation for inserting the insulator relative to the outer conductor terminal body and the operation for inserting the inner conductor terminal relative to the insulator are effected along an axial direction of the outer conductor terminal body.

DISCLOSURE OF THE INVENTION

Problem that the Invention is to Solve

In the above conventional technique, there are many operation steps related to the assembling, and there is a problem that the operation efficiency is affected by this. Furthermore, in the above conventional technique, the operation for inserting the insulator relative to the outer conductor terminal body and the operation for inserting the inner conductor terminal relative to the insulator attached to the outer conductor terminal body are effected along the axial direction of the outer conductor terminal body, and therefore particularly in the case of the small-size parts, it is difficult to see, and also it is difficult to know the amount of insertion, and therefore there is a problem that the operation efficiency is affected.

Furthermore, in the above conventional technique, there are required a plurality of structures for different types of fixings, including the structure for retaining the outer conductor terminal body and the insulator relative to each other, the structure for fitting the outer conductor terminal body and the shielding member together, and the structure for press-crimping the braid of the coaxial cable and the press-crimping pieces of the shielding member together, and therefore there is a problem that the facilities and the operation efficiency are influenced.

The present invention has been made in view of the above circumstances, and its object is to provide a coaxial connector and a coaxial connector assembling method, in which the operation efficiency can be enhanced, and also facilities related to the assembling can be simplified.

Means for Solving the Problem

A coaxial connector according to the present invention in order to solve the problems, comprises: an insulator assembly including a coaxial cable having a core wire and a braid disposed at the outside of the core wire, an inner conductor terminal having a core wire connection portion connected to the core wire, and an insulator receiving and holding the inner conductor terminal therein; an outer conductor terminal of a substantially cylindrical shape which has an opening portion for setting the insulator assembly from a direction perpendicular to a terminal axis thereof, and holds the insulator assembly; a pair of press-crimping pieces for braid connection which are formed at the outer conductor terminal, and are connected to the braid; and a pair of press-crimping pieces for insulator holding which hold the insulator at an opening edge of the opening portion.

It is preferable that, in the coaxial connector, the insulator has annular flange portions formed respectively at front and rear sides of a held portion held by the pair of press-crimping pieces for insulator holding. and the pair of press-crimping pieces for insulator holding are formed into an inwardly-inclined shape so that their distal end gap conforms to a diameter of the held portion and that their side portions abut against the front and rear flange portions.

It is preferable that, in the coaxial connector, the outer conductor terminal has a plurality of spring structural portions for connection to a mating connector, the plurality of spring structural portions being formed at a base portion disposed at a side opposite from the opening portion, and disposed forwardly of the position of the pair of press-crimping pieces for insulator holding.

Further, a method of assembling a coaxial connector according to the present invention in order to solve the problems, comprises: a first step of assembling a coaxial cable, an inner conductor terminal and an insulator together to form an insulator assembly; a second step of setting the insulator assembly through an opening portion of a substantially-tubular outer conductor terminal from a direction perpendicular to a terminal axis thereof; and a third step of holding the insulator of the insulator assembly by press-crimping a pair of press-crimping pieces for insulator holding formed at an opening edge of the opening portion, and effecting the connection to a braid of the coaxial cable of the insulator assembly by press-crimping a pair of press-crimping pieces for braid connection disposed rearwardly of the opening portion.

In the present invention, the insulator assembly is formed, and this insulator assembly is set from the upper side of the outer conductor terminal through the upper opening portion, and then merely by press-crimping at least the pair of press-crimping pieces for insulator holding and the pair of press-crimping pieces for braid connection, the assembling of the coaxial connector is completed. The setting of the insulator assembly relative to the outer conductor terminal is a simple and easily-seen operation in which it is merely lowered from the upper side of the outer conductor terminal. The assembling of the coaxial connector can be made possible merely by providing press-crimping facilities.

In the present invention, by forming the pair of press-crimping pieces for insulator holding into the inwardly-inclined condition, the setting of the insulator assembly relative to the outer conductor terminal can be effected smoothly. Also, the operation after the setting can be effected smoothly. Namely, by inclining the pair of press-crimping pieces for insulator holding inwardly to thereby adjust the gap therebetween, the setting of the insulator assembly is made possible only at a predetermined position. Also, after the setting, the movement of the insulator assembly in the forward-rearward direction is restrained by the abutting engagement of the pair of inclined press-crimping pieces for insulator holding with the flange portions, and during the time until the application of the press-crimping, the position of the insulator assembly is made stable.

In the present invention, by providing the plurality of spring structural portions at the outer conductor terminal, it can be formed into a multi-contact structure with respect to the connection to the mating connector. With the plurality of spring structural portions, there can be provided the coaxial connector having a good anti-noise property.

Advantage of the Invention

In the above coaxial connector, by providing the outer conductor terminal which has the upper opening portion disposed at the open side of the press-crimping pieces for braid connection and extending forwardly from the position of these press-crimping pieces for braid connection, and further has the pair of press-crimping pieces for insulator holding formed at the opening edge of the upper opening portion, the insulator assembly comprising the coaxial cable, the inner conductor terminal and the insulator can be mounted with a good operation efficiency. Therefore, there is achieved an advantage that the coaxial connector having the better operation efficiency than in the past can be provided. Furthermore, in the present invention, the insulator assembly can be fixed and connected to the outer conductor terminal only by press-crimping. Therefore, there is achieved an advantage that the facilities related to the assembling can be more simplified than in the past.

Furthermore, in the case where the insulator of the above coaxial connector has the annular flange portions formed respectively at the front and rear sides of the held portion to be held by the pair of press-crimping pieces for insulator holding and where the pair of press-crimping pieces for insulator holding are formed into the inwardly-inclined shape such that their distal end gap conforms to the diameter of the held portion and that their side portions abut against the front and rear flange portions, the position of setting of the insulator assembly can be made clear, and also the position of the insulator assembly during the time from the setting to the application of the press-crimping can be made stable. Therefore, there is achieved an advantage that the operation efficiency can be further enhanced.

Furthermore, in the case where the outer conductor terminal of the above coaxial connector has the plurality of spring structural portions for connection to the mating connector, the plurality of spring structural portions being formed at the base portion disposed at that side opposite from the opening portion, and disposed forwardly of the position of the pair of press-crimping pieces for insulator holding, the outer conductor terminal can be formed into the multi-contact structure, and in addition to the above advantages, there is achieved an advantage that an anti-nose property can also be taken into consideration.

And, in the above coaxial connector assembling method, there is achieved an advantage that there can be provided the assembling method in which the operation efficiency can be more enhanced than in the past, and also the simplification of the facilities can be achieved.

DESCRIPTION OF THE REFERENCE NUMERALS AND SIGNS

Figure 1:
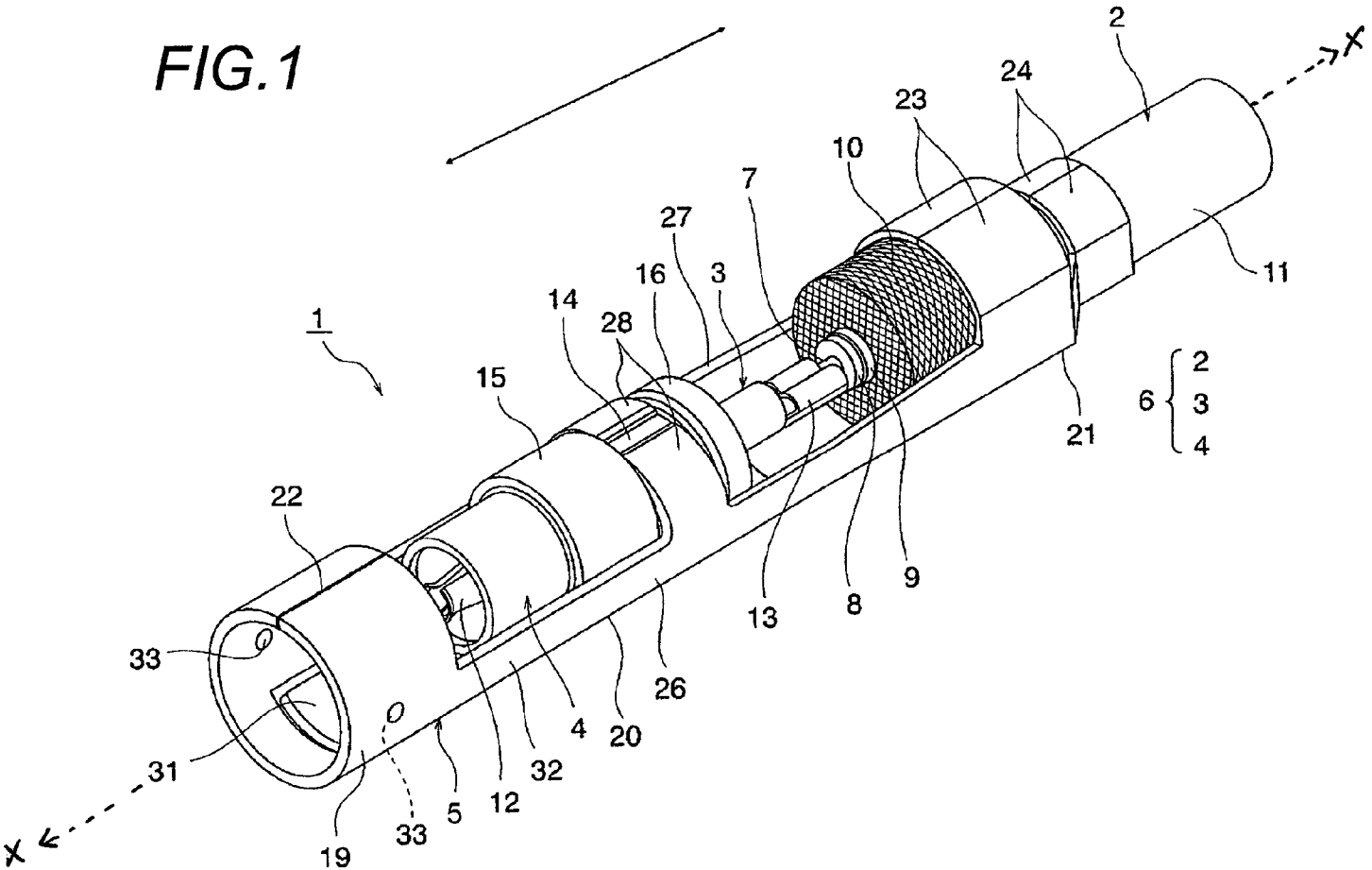
FIG. 1 is a perspective view showing one embodiment of a coaxial connector of the present invention.

1 coaxial connector
2 coaxial cable
3 inner conductor terminal
4 insulator
5 outer conductor terminal
6 insulator assembly
7 core wire
8 insulator
9 metallic tape conductor
10 braid
11 insulative sheath
12 electrical contact portion
13 core wire connection portion
14 held portion
15, 16 flange portion
17, 18 abutting surface
22 joint line
23 press-crimping piece for braid connection
24 press-crimping piece for sheath fixation
26 lower base portion
27 upper opening portion
28 press-crimping piece for insulator holding
29 side portion
30 slit
31 first contact spring (spring structural portion)
32 second contact spring (spring structural portion)
33 contact indent
34 retaining hole

BEST MODE FOR CARRYING OUT THE INVENTION

Figure 2:
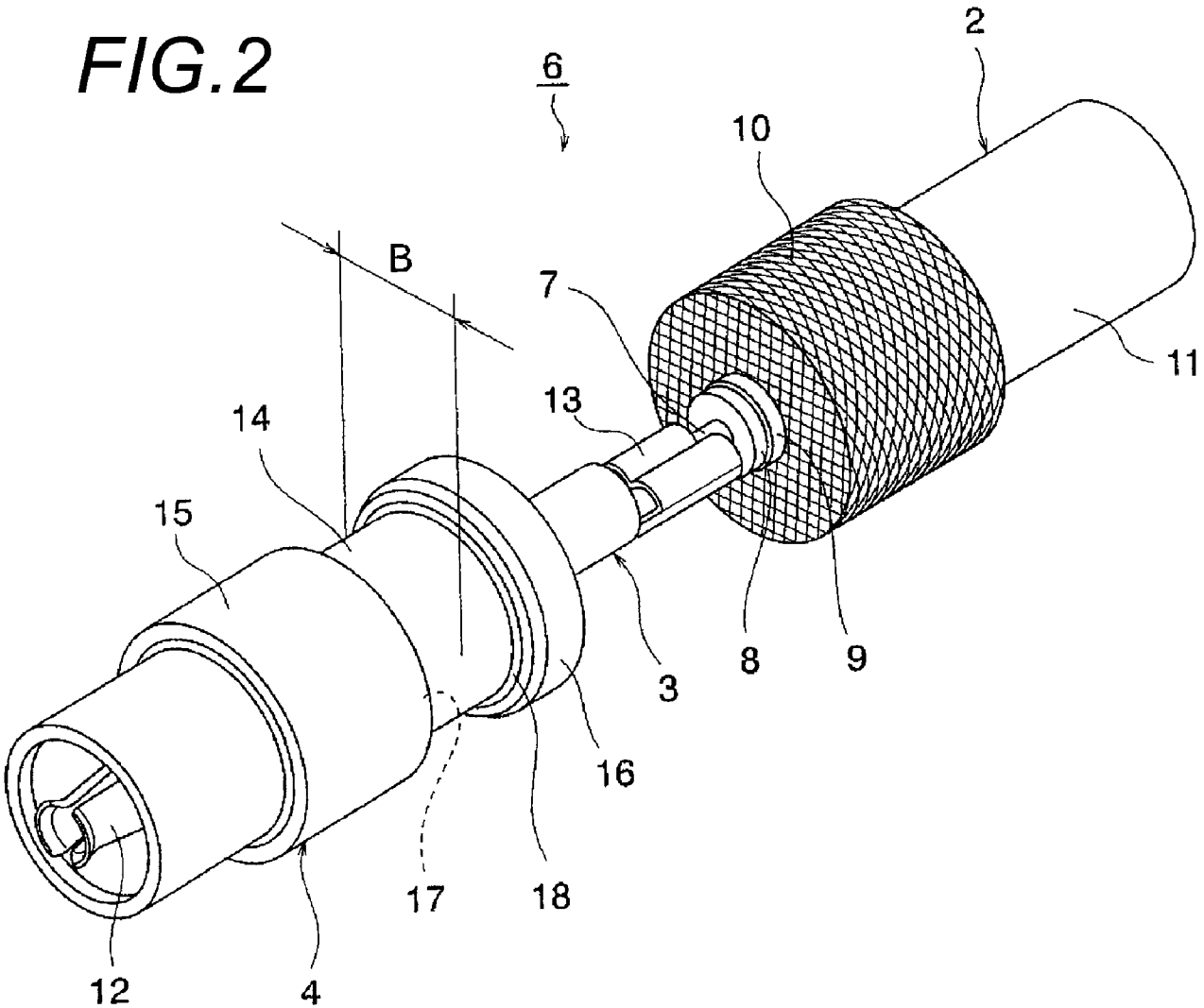
FIG. 2 is a perspective view of an insulator assembly.
Figure 3:
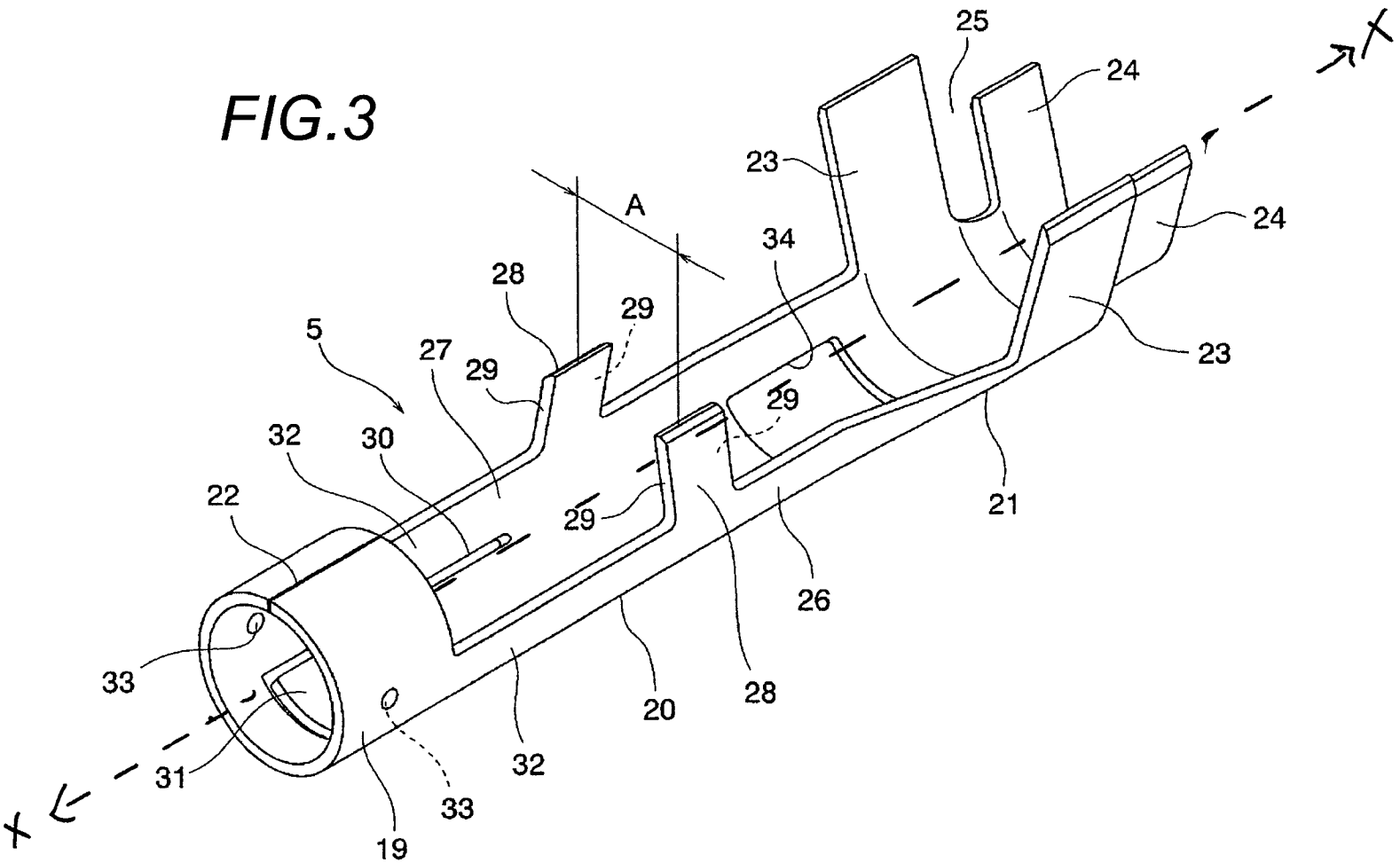
FIG. 3 is a perspective view of an outer conductor terminal as seen from a side of the upper opening portion.
Figure 4:
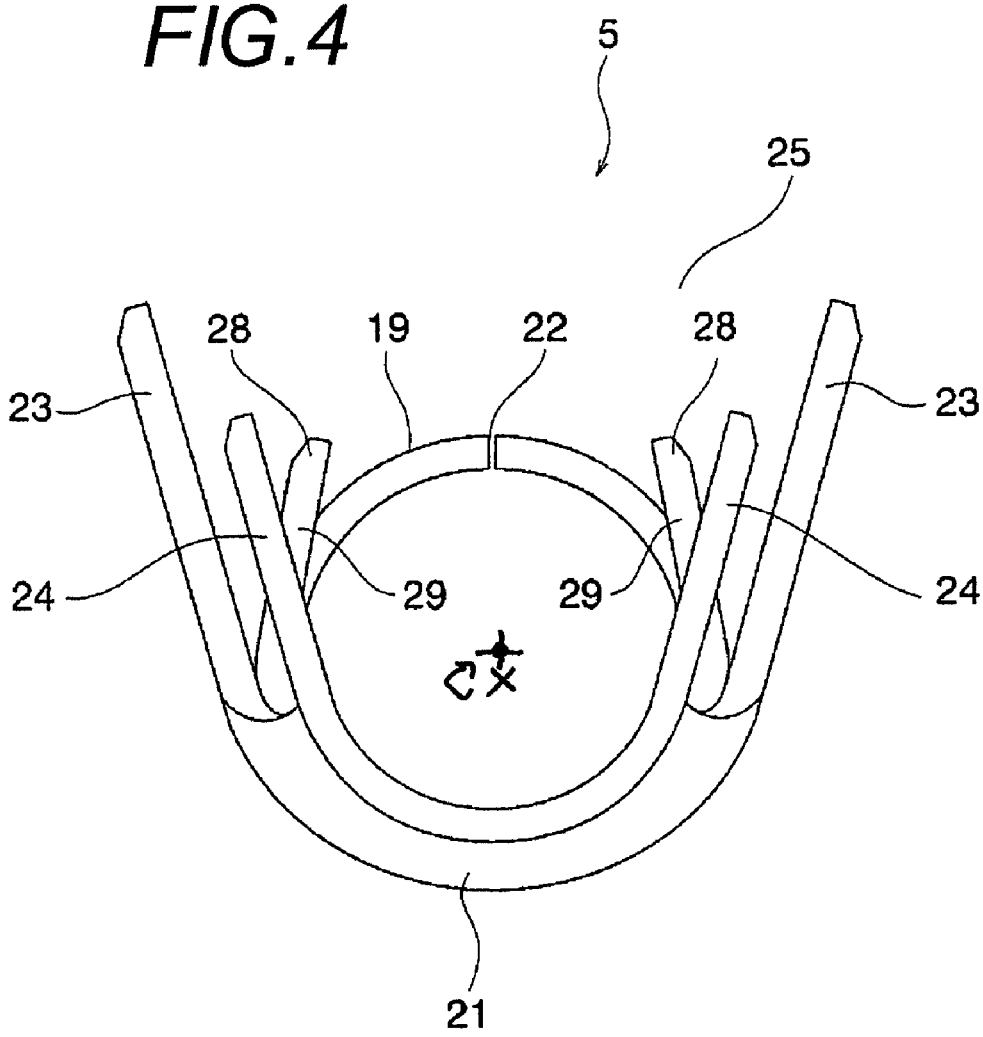
FIG. 4 is a rear view of the outer conductor terminal.
Figure 5:
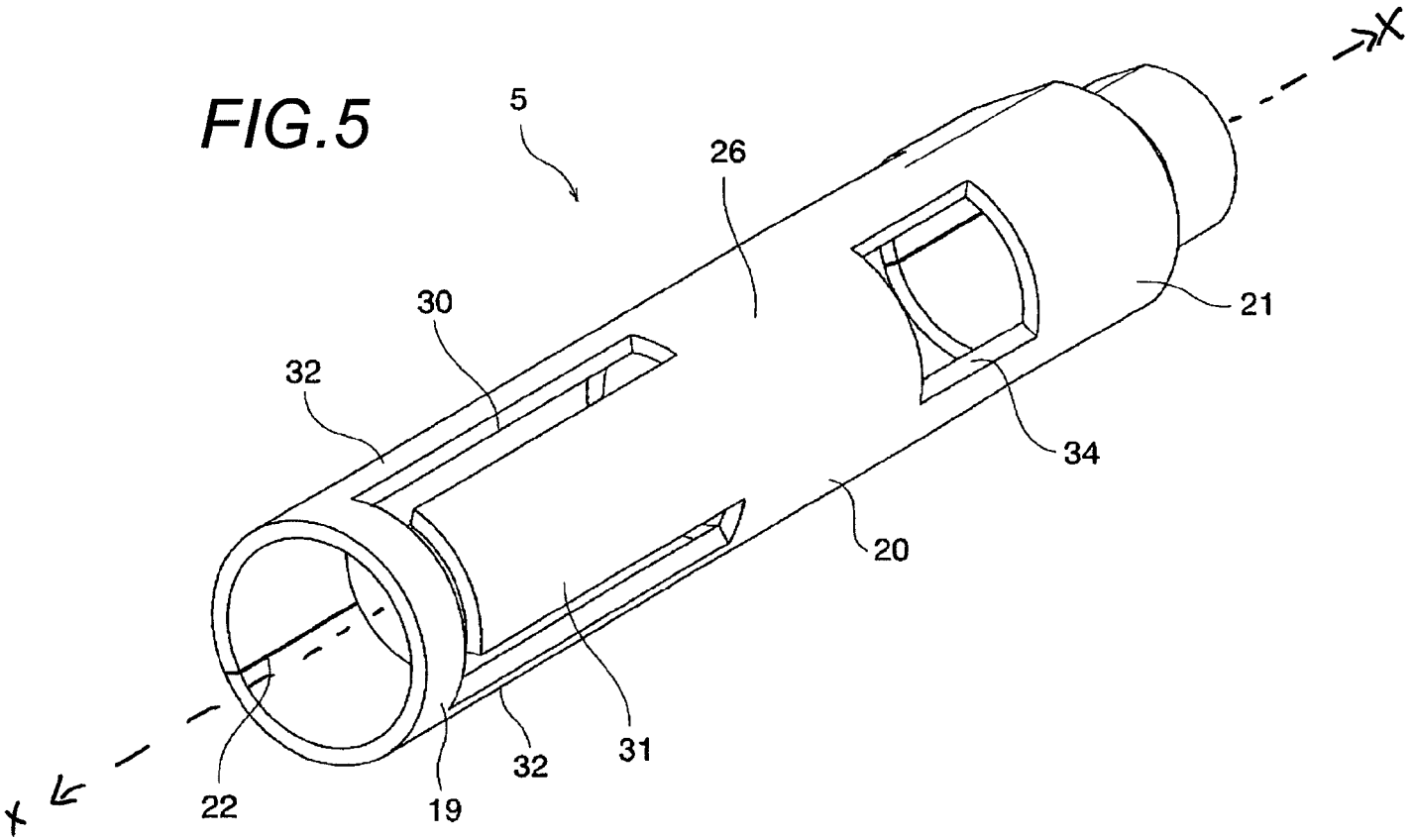
FIG. 5 is a perspective view of the outer conductor terminal as seen from a side of the lower base portion.
Figure 6:
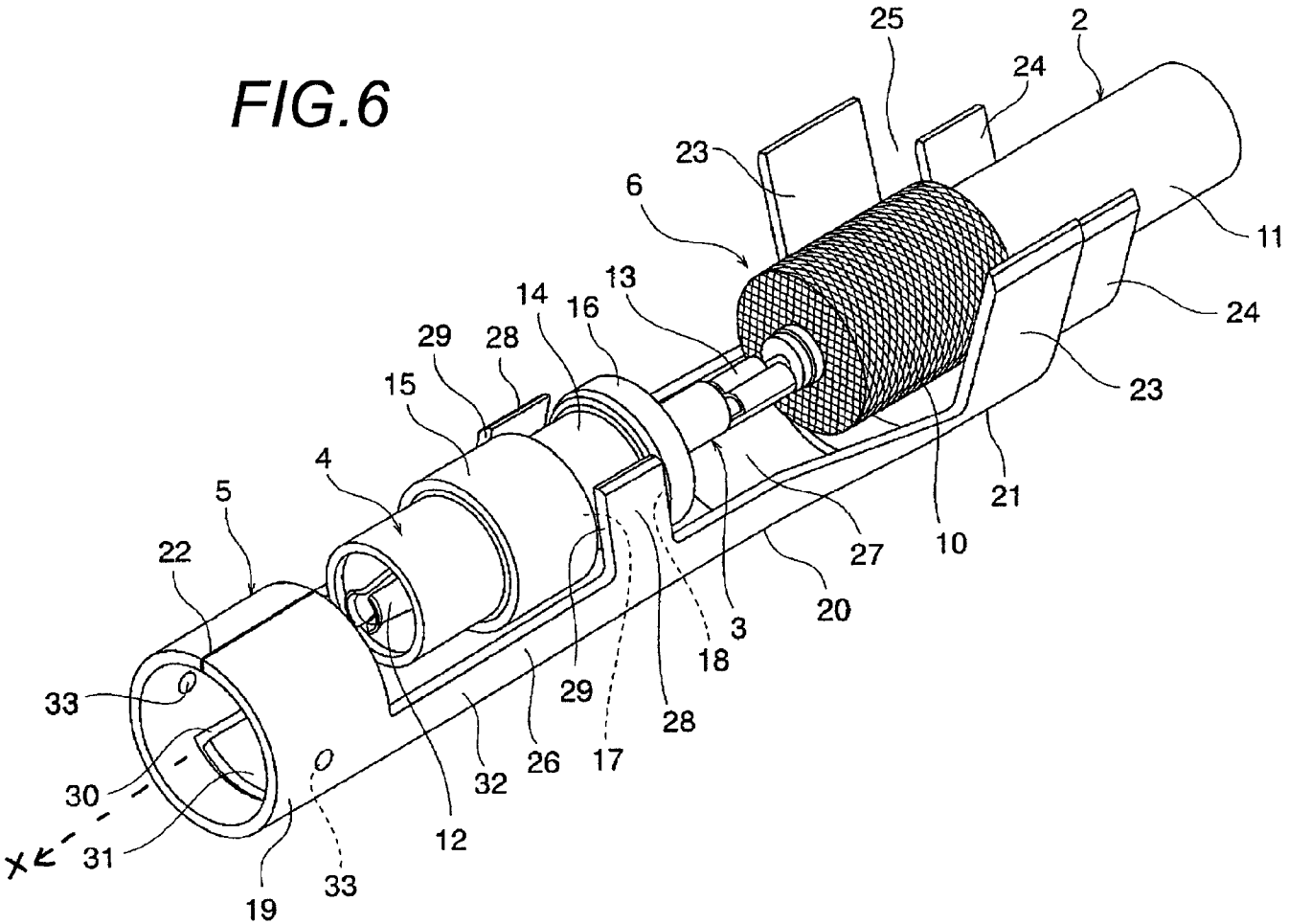
FIG. 6 is a perspective view showing a condition in which the insulator assembly is set in the outer conductor terminal.

Description will be made below with reference to the drawings. FIG. 1 is a perspective view showing one embodiment of a coaxial connector of the present invention. FIG. 2 is a perspective view of an insulator assembly, FIG. 3 is a perspective view of an outer conductor terminal as seen from a side of the upper opening portion, FIG. 4 is a rear view of the outer conductor terminal, FIG. 5 is a perspective view of the outer conductor terminal as seen from a side of the lower base portion, and FIG. 6 is a perspective view showing a condition in which the insulator assembly is set in the outer conductor terminal.

In FIG. 1, the coaxial connector 1 is a connector adapted to be provided at an end of a coaxial cable 2, and comprises an inner conductor terminal 3, an insulator 4, and the outer conductor terminal 5. The coaxial connector 1 of the present invention is formed by an assembling operation in which the insulator assembly 6, comprising the coaxial cable 2, the inner conductor terminal 3 and the insulator 4, is connected and fixed to the outer conductor terminal 5. A two-directional arrow in FIG. 1 indicates a forward-rearward direction. First, each of the constituent members will be described.

In FIG. 1 and FIG. 2, the insulator assembly 6 includes an end of the coaxial cable 2. The coaxial cable 2 is already known, and comprises, in outward order from the center, a core wire 7 as a center conductor, an insulator 8 as a dielectric member, a metallic tape conductor 9 and a braid 10 as an outer conductor, and an insulative sheath 11 as an outer covering. The coaxial cable 2 is processed such that the core wire 7 is exposed over a predetermined length. The braid 10 is processed into such a condition that it is folded back on the insulative sheath 11 so as to be connectable to the outer conductor terminal 5.

The inner conductor terminal 3 is a metallic member having electrical conductivity, and has an electrical contact portion 12 and a core wire connection portion 13 continuous with this electrical contact portion 12. The core wire connection portion 13 is formed into such a shape that it forms a pair of press-crimping pieces, and it can be connected and fixed to the core wire 7 of the coaxial cable 2 by press-crimping.

The insulator 4 is a so-called dielectric, and is molded using a synthetic resin material having an insulative nature, and is formed into a substantially cylindrical shape. The insulator 4 is formed so as to receive and hold the inner conductor terminal 3 therein. A held portion 14 related to the fixing to the outer conductor terminal 5 is formed at an outer peripheral surface of the insulator 4. Further, annular flange portions 15, 16 larger in diameter than the held portion 14 are formed respectively at the front and rear sides of this held portion 14. Abutting surfaces 17, 18 are formed respectively at the flange portions 15, 16 by steps formed between them and the held portion 14. The held portion 14 and the abutting surfaces 17, 18 will be described later.

In FIG. 1, FIG. 3, FIG. 4 and FIG. 5, the outer conductor terminal 5 is formed into a substantially cylindrical shape by press-working a metal sheet having electrical conductivity. Here, the outer conductor terminal 5 is divided into a front portion 19, an intermediate portion 20 and a rear portion 21 (see FIG. 3), and the front portion 19 and its vicinity are formed as a portion for connection with a mating connector (not shown). The front portion 19 is formed into a cylindrical shape (annular shape). A joint line 22 produced by the above press-working is formed on an upper side of the front portion 19.

A pair of press-crimping pieces for braid connection 23 and a pair of press-crimping pieces for sheath fixation 24 are formed at the rear portion 21 of the outer conductor terminal 5. The pair of press-crimping pieces for braid connection 23 and the press-crimping pieces for sheath fixation 24 are arranged to be juxtaposed to each other in the forward-rearward direction. Also, the pair of press-crimping pieces for braid connection 23 and the press-crimping pieces for sheath fixation 24 are formed into such a shape that their distal ends are open gradually outwardly. The pair of press-crimping pieces for braid connection 23 are so formed to connect and fix the braid 10 of the coaxial cable 2 by press-crimping, and the pair of press-crimping pieces for sheath fixation 24 are so formed to fix the insulative sheath 11 by press-crimping. The pair of press-crimping pieces for braid connection 23 are formed to project longer than the pair of press-crimping pieces for sheath fixation 24. The pair of press-crimping pieces for braid connection 23 and the press-crimping pieces for sheath fixation 24 are formed such that an opening portion 25 is formed before the press-crimping (see FIG. 4).

A lower base portion 26 of a semi-cylindrical shape which is continuous with the front portion 19 and continuous with the pair of press-crimping pieces for braid connection 23 of the rear portion 21 is formed at the intermediate portion 20 of the outer conductor terminal 5. Also, an upper opening portion 27 is formed at the intermediate portion 20 to open the whole of the upper side of this intermediate portion 20. A pair of press-crimping pieces for insulator holding 28 for holding the insulator 8 of the insulator assembly 6 by press-crimping are formed respectively at opening edges of the upper opening portion 27. The pair of press-crimping pieces for insulator holding 28 are disposed and formed at a middle position in the forward-rearward direction. The pair of press-crimping pieces for insulator holding 28 are formed into an inwardly-inclined shape so that their distal end gap A conforms to a diameter B of the held portion 14 of the insulator assembly 6 (for example, A≈B) and that side portions 29 can abut against the abutting surfaces 17, 18 of the flange portions 15, 16 of the insulator assembly 6.

A plurality of spring structural portions for connection to the mating connector (not shown) are formed at the lower base portion 26. The spring structural portions are disposed and formed forwardly of the position of the pair of press-crimping piece for insulator holdings 28. In this embodiment, they are disposed and formed to extend over the front portion 19. The spring structural portions comprise a first contact spring 31 provided by forming a U-shaped slit 30 (see FIG. 5) in the lower base portion 26, and a pair of second contact springs 32 which can be open outwardly at both sides of this first contact spring 31 by the joint line 22 in the front portion 19 (This is one example.). A contact indent 33 is formed at the second contact spring 32. Taking an anti-noise property into consideration, the spring structural portions has a multi-contact structure with respect to the connection to the mating connector (not shown). Incidentally, by forming the spring structural portions of this embodiment into the illustrated shapes, they have such a structure that a compact design can be achieved.

A retaining hole 34 for being retained by a lance or the like is formed in the lower base portion 26. The retaining hole 34 functions also as a portion for avoiding contact with the inner conductor terminal 3.

Next, one example of a method of assembling the coaxial connector 1 will be described based on the above construction and structure. The method of assembling the coaxial connector 1 comprises a first step of forming the insulator assembly 6, a second step of setting the insulator assembly 6 in the outer conductor terminal 5 through the upper opening portion 27 of the outer conductor terminal 5 from a direction perpendicular to the longitudinal axis X of the outer conductor terminal 5, and a third step of holding the insulator 4 of the insulator assembly 6 by press-crimping the pair of press-crimping piece for insulator holdings 28 and effecting the connection and fixing of the insulator assembly 6 to the coaxial cable 2 by press-crimping the pair of press-crimping pieces for braid connection 23 and the pair of press-crimping pieces for sheath fixation 24. The assembling method will be described below in a little more detail.

In FIG. 2, the inner conductor terminal 3 is received and held in the interior of the insulator 4, and thereafter when the core wire connection portion 13 of the inner conductor terminal 3 and the core wire 7 of the coaxial cable 2 are press-crimped together to be connected and fixed together, the assembling of the insulator assembly 6 is completed. Then, when this insulator assembly 6 is merely lowered from the upper side of the outer conductor terminal 5 through the upper opening portion 27 to be set in the outer conductor terminal 5, a set condition as shown in FIG. 6 is formed. At this time, the setting of the insulator assembly 6 is made possible only at a predetermined position since the diameter B of the held portion 14 of the insulator assembly 6 and the distal end gap A of the pair of press-crimping pieces for insulator holding 28 of the outer conductor terminal 5 are adjusted to substantially the same dimension.

Incidentally, in the set condition as shown in FIG. 6, the movement of the insulator assembly 6 in the forward-rearward direction is restrained by the pair of press-crimping pieces for insulator holding 28 and the flange portions 15, 16, and therefore the set position is made stable. Specifically, the forward-rearward movement is restrained by the abutting engagement of the side portions 29 of the pair of press-crimping pieces for insulator holding 28 with the abutting surfaces 17, 18, and therefore the set position of the insulator assembly 6 is made stable.

When the pair of press-crimping pieces for insulator holding 28 are press-crimped after the insulator assembly 6 is set in the outer conductor terminal 5, the held portion 14 of the insulator 4 of the insulator assembly 6 is held. Also, when the pair of press-crimping pieces for sheath fixation 24 are press-crimped, the insulative sheath 11 of the coaxial cable 2 of the insulator assembly 6 is held. The insulator assembly 6 is held at these two portions, so that the fixing thereof to the outer conductor terminal 5 is completed. Further, when the pair of press-crimping pieces for braid connection 23 are press-crimped, the braid 10 of the coaxial cable 2 of the insulator assembly 6 is contacted with the press-crimping pieces for braid connection 23, so that its connection to the outer conductor terminal 5 is completed. With the foregoing, the assembling is completed, and the coaxial connector 1 as shown in FIG. 1 is formed.

In the coaxial connector 1 of the present invention, the setting of the insulator assembly 6 relative to the outer conductor terminal 5 is the simple and easily-seen operation in which it is merely lowered from the upper side, and besides after the setting, the assembling is completed by the operation for merely effecting the press-crimping. Therefore, there is achieved an advantage that the operation efficiency can be more enhanced than in the past. Also, there is achieved an advantage that the facilities related to the assembling can be more simplified than in the past.

The present invention can, of course, be carried out in variously-changed ways in so far as the subject matter of the present invention is not changed.

INDUSTRIAL APPLICABILITY

In the coaxial connector and the coaxial connector assembling method of the present invention, the operation efficiency can be enhanced, and also the facilities related to the assembling can be simplified.

The invention claimed is:

1. A coaxial connector comprising:

an insulator assembly including a coaxial cable having a core wire and a braid disposed at the outside of the core wire, an inner conductor terminal having a core wire connection portion connected to the core wire, and an insulator receiving and holding the inner conductor terminal therein;

an outer conductor terminal of a substantially cylindrical shape which has an opening portion for setting the insulator assembly from a direction perpendicular to a longitudinal axis of the outer conductor terminal, and holds the insulator assembly;

a pair of press-crimping pieces for braid connection which are formed at the outer conductor terminal, and are connected to the braid; and a pair of press-crimping pieces for insulator holding which hold the insulator at an opening edge of the opening portion, wherein the outer conductor terminal has a plurality of spring structural portions for connection to a mating connector, the plurality of spring structural portions being formed at a base portion of the outer conductor terminal disposed at a side opposite from the opening portion and on which the insulator assembly is set, and the spring structural portions being disposed forwardly of the position of the pair of press-crimping pieces for insulator holding.

2. The coaxial connector as set forth in claim 1, wherein a U-shaped slit is formed on the base portion of the outer conductor terminal on the opposite side from the opening portion.

3. The coaxial connector as set forth in claim 1, wherein a retaining hole is formed on the base portion of the outer conductor terminal on the opposite side from the opening portion.

4. A coaxial connector comprising:

an insulator assembly including a coaxial cable having a core wire and a braid disposed at the outside of the core wire, an inner conductor terminal having a core wire connection portion connected to the core wire, and an insulator receiving and holding the inner conductor terminal therein;

an outer conductor terminal of a substantially cylindrical shape which has an opening portion for setting the insulator assembly from a direction perpendicular to a longitudinal axis of the outer conductor terminal, and holds the insulator assembly;

a pair of press-crimping pieces for braid connection which are formed at the outer conductor terminal, and are connected to the braid; and a pair of press-crimping pieces for insulator holding which hold the insulator at an opening edge of the opening portion, wherein the insulator has annular flange portions formed respectively at front and rear sides of a held portion held by the pair of press-crimping pieces for insulator holding and the pair of press-crimping pieces for insulator holding are formed into an inwardly-inclined shape so that their distal end gap conforms to a diameter of the held portion and that their side portions abut against the front and rear flange portions.

5. A method of assembling a coaxial connector, comprising:

a first step of assembling a coaxial cable, an inner conductor terminal and an insulator together to form an insulator assembly;

a second step of setting the insulator assembly through an opening portion of a substantially-tubular outer conductor terminal from a direction perpendicular to a longitudinal axis of the outer conductor terminal; and a third step of holding the insulator of the insulator assembly by press-crimping a pair of press-crimping pieces for insulator holding formed at an opening edge of the opening portion, and effecting the connection to a braid of the coaxial cable of the insulator assembly by press-crimping a pair of press-crimping pieces for braid connection disposed rearwardly of the opening portion, wherein the outer conductor terminal has a plurality of spring structural portions for connection to a mating connector, the plurality of spring structural portions being formed at a base portion of the outer conductor terminal disposed at a side opposite from the opening portion and on which the insulator assembly is set, and the spring structural portions being disposed forwardly of the position of the pair of press-crimping pieces for insulator holding.

6. A method of assembling a coaxial connector comprising:

a first step of assembling a coaxial cable, an inner conductor terminal and an insulator together to form an assembly;

a second step of setting the insulating assembly through an opening of a substantially-tubular outer conductor terminal from a direction perpendicular to a longitudinal axis of the outer conductor terminal; and a third step of holding the insulator of the insulator assembly by press-crimping a pair of press-crimping pieces for insulator holding formed at an opening edge of the opening portion, and effecting the connection to a braid of the coaxial cable of the insulator assembly by press-crimping a pair of press-crimping pieces for braid connection disposed rearwardly of the opening portion, wherein the insulator has annular flange portions formed respectively at front and rear sides of a held portion held by the pair of press-crimping pieces for insulator holding, and the pair of press-crimping pieces for insulator holding are formed into an inwardly-inclined shape so that their distal end gap conforms to a diameter of the held portion and that their side portions abut against the front and rear flange portions.

* * * * *